United States Patent [19]

Dijksman et al.

[11] Patent Number: 5,038,570

[45] Date of Patent: Aug. 13, 1991

[54] PISTON ENGINE AND CRYO-COOLER PROVIDED WITH SUCH A PISTON ENGINE

[75] Inventors: Johan F. Dijksman; Ronald Den Heyer, both of Eindhoven; Adrianus H. Meesterburrie, Helmond; Theodorus F. E. M. Overes; Peter G. M. Simons, both of Eindhoven, all of Netherlands

[73] Assignee: U.S. Philips Corporation, New York, N.Y.

[21] Appl. No.: 383,900

[22] Filed: Jul. 20, 1989

Related U.S. Application Data

[63] Continuation of Ser. No. 317,114, Feb. 28, 1989, abandoned, which is a continuation of Ser. No. 194,763, May 17, 1988, abandoned.

[30] Foreign Application Priority Data

Jan. 11, 1988 [NL] Netherlands ..... 8800055

[51] Int. Cl.[5] ..... F02G 1/04; F25B 9/00

[52] U.S. Cl. ..... 62/6; 60/520; 92/173

[58] Field of Search ..... 60/517, 520; 62/6; 92/173

[56] References Cited

U.S. PATENT DOCUMENTS

| | | | |
|---|---|---|---|
| 4,391,103 | 7/1983 | Sarcia | 60/520 X |
| 4,550,571 | 11/1985 | Bertsch | 60/517 X |
| 4,578,956 | 4/1986 | Young | 62/6 |
| 4,769,997 | 9/1988 | Pundak | 60/520 |

*Primary Examiner*—Allen M. Ostrager
*Attorney, Agent, or Firm*—Brian J. Wieghaus

[57] ABSTRACT

A piston engine having a piston (13) journalled in radial direction with respect to the direction of movement. The rotation-free piston (13) is centered by means of two pairs of dynamic groove bearings (41,43), (47,49) with respect to a cylinder axis (39). The piston engine is particularly suitable for use in cryo-coolers.

25 Claims, 6 Drawing Sheets

PISTON ENGINE AND CRYO-COOLER PROVIDED WITH SUCH A PISTON ENGINE

This is a continuation of application Ser. No. 317,114, filed Feb. 28, 1989, now abandoned, which is a continuation of application Ser. No. 194,763, filed May 17, 1988, now abandoned.

BACKGROUND OF THE INVENTION

The invention relates to a piston engine comprising a piston, which is movable in a reciprocating manner in a cylinder, displaces a gaseous medium and is journalled in a radial direction with respect to the direction of movement of the piston by means of at least one dynamic groove bearing.

The invention further relates to a cryo-cooler provided with a piston engine of the kind mentioned.

In a piston engine known from European Patent Application EP-A1-0223288 corresponding to U.S. Pat. application Ser. No. 928,063, (PHN 11538) of the kind mentioned in the opening paragraph, the piston rotatable in the cylinder is provided with a dynamic groove bearing. In a large number of cases, it is objectionable to subject the piston engine to a combined rotary and translatory movement. Thus, it is no longer possible to provide by means of a dynamic groove bearing on the outer side of the piston a radial journalling of the translating piston. A rotation of the piston is impossible, for example, when the piston is coupled to the coil of a linear electric driving motor. The electrical connections required are capable of withstanding only a limited rotation. It further appears increasingly more difficult to bring the tolerances of piston and cylinder (radial gap width) into conformity with the dimensions in radial direction of an optimally operating dynamic groove bearing. This is the more the case as the piston engine is a so-called cryo-cooler, in which the piston is constituted by a free displacer. The requirements imposed in such a cryo-cooler on the radial gap width in connection with variations in the phase difference between the translatory movement of the free displacer and the translatory movement of the piston are generally of a quite different nature from the requirements with respect to an optimally operating groove bearing and the attainable manufacturing tolerances. The comparatively great temperature differences over the displacer also influence the radial gap width.

SUMMARY OF THE INVENTION

The invention has for its object to provide a piston engine, in which the possibility of bringing manufacturing tolerances, thermodynamic properties and bearing properties into conformity with each other is considerably enlarged.

The piston engine according to the invention is for this purpose characterized in that the rotation-free piston is centered by means of at least two pairs of dynamic groove bearings with a piston axis with respect to a cylinder axis, this cylinder axis coinciding with a longitudinal axis of an elongate circular-cylindrical guide, which is stationary in the direction of movement of the piston and on which one of the pairs of dynamic groove bearings is located.

The invention is based on the principle of separation of the locations at which the piston is journalled and the locations at which manufacturing tolerances are comparatively strongly determinative of the thermodynamic properties of the engine or/and the gas leakage between piston or displacer and cylinder.

A particular embodiment of a piston engine having a compact light construction is characterized in that the other pair of dynamic groove bearings is located on a rotary member, preferably an elongate circular cylindrical pipe, which is rotatable about the cylinder axis with respect to the guide and the piston, is coupled to a rotary motor and is arranged to surround concentrically the circular-cylindrical guide.

A further embodiment of the piston engine having a comparatively simply constructed piston is characterized in that the piston is provided with a translatory member, also preferably in the form of a circular cylindrical pipe, which is coaxial with respect to the cylinder axis, is centered by means of one of the pairs of dynamic groove bearings with respect to the cylinder axis and is arranged to surround at least partially the circular-cylindrical guide.

A still further embodiment of the piston engine, which has a comparatively short piston construction, is characterized in that the translatory member is located at least in part within the piston.

Another embodiment of the piston engine, in which a dynamic bearing is utilized for control of a central position of the piston, is characterized in that one of the dynamic groove bearings is a gas pump, which brings about a transport from a buffer space of the piston engine to a chamber limited by a chamber wall connected to the piston and the circular-cylindrical guide, the speed of rotation of the electrical rotary motor coupled to the rotary pipe being controllable by means of a position sensor detecting the axial position of the piston and supplying a position signal related to this position to a comparator for obtaining a control signal for the rotary motor.

A particular embodiment of the piston engine forming part of a cryo-cooler is characterized in that the piston is constituted by a displacer movable in a reciprocating manner in an expansion space, this expansion space communicating through a duct with a compression space, in which a reciprocating compression piston is disposed.

The invention will now be described more fully with reference to the drawing in which:

DESCRIPTION OF THE PREFERRED EMBODIMENT

Figure 1:
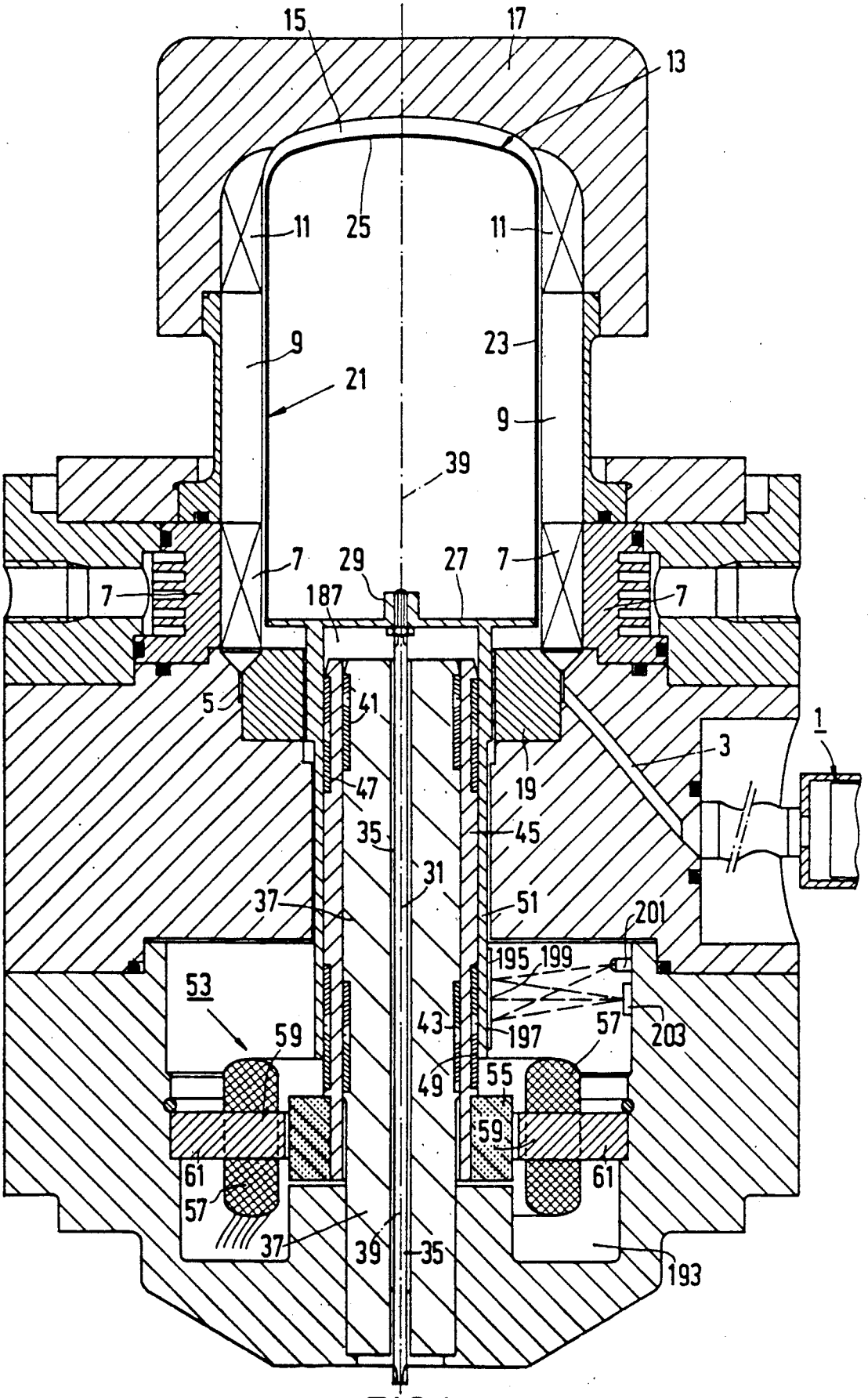
FIG. 1 is a sectional view of a first embodiment of the piston engine.

The first embodiment of the piston engine shown in FIG. 1 is intended to be coupled to a compressor of the kind shown, for example, in FIG. 5 still to be disclosed further below. The combination of the piston engine shown in FIG. 1 and a compressor also to be considered in itself as a piston engine forms a so-called cryo-cooler. In FIG. 1, the compressor is indicated diagrammatically by reference numeral 1. The gas pressure fluctuations produced by the compressor 1 are supplied through a duct 3 to an annular space 5, which is in communication via a cooler 7, a regenerator 9 and a freezer 11 with an expansion space 15 located above a displacer 13. Preferably, helium gas is used as working medium. The compressor 1 can be driven by means of a linear electric motor, such as a brushless direct current motor, but also by means of a mechanical, hydraulic or pneumatic motor. The drive of the displacer 13 may be a so-called drive on flow losses (causing a pressure difference over the displacer), a drive by means of a linear electric motor or a combination of these two drives. In the piston engine shown in FIG. 1, the rotation-free displacer 13 is driven on flow losses. The cylinder for the displacer 13 movable in a reciprocating manner is constituted by the inner walls of the cooler 7, the regenerator 9, the freezer 11 and a cover 17. On the lower side, the cylinder is limited by a ring, or diagrammatically by an arrow and the reference numeral 21 at the area of the inner wall of the regenerator 9. In the piston engine shown in FIG. 1, the displacer 13 has a comparatively thin-walled circular-cylindrical part 23 with an adjoining dome 25 and a comparatively thick cover plate 27, which is welded to the cylindrical part 23. The displacer 13 is made of stainless steel. At the center of the circular cover plate 27, a projection 29 with a threaded hole is provided, in which a rod 31 is secured by means of a nut 33. The thread acts as a restriction in such a manner that the average pressure prevails in the displacer. The rod 31 is slidably guided in an elongate bore 35 of a fixedly arranged circular-cylindrical guide 37 and serves as securing means or coupling means for a mechanical spring that may be necessary in a cryo-cooler and/or a linear electric motor. This will be explained more fully in the third embodiment of the piston engine shown in FIG. 3 to be described hereinafter. In the case of a correct centering of the piston/displacer 13 in the cylinder 21, a piston axis/displacer axis 39 coincides with the center line of the cylinder 21 (cylinder axis or frame axis) and the center line of the circular-cylindrical guide 37. If there is started from accurate dimensions of the displacer 13, the cylinder 23 and the circular-cylindrical guide 37 as well as from an accurate mounting of the said three parts, statically the center lines of the three parts coincide. In order that it is now also achieved that dynamically, upon translation of the displacer 13 with respect to the cylinder 21 an accurate centering of the displacer 13 with respect to the axis 39 remains guaranteed, the piston engine is provided with two pairs of dynamic groove bearings. A first pair of groove bearings 41,43 is disposed on the circular-cylindrical guide 37 and ensures that a rotary pipe 45 is journalled radially with respect to the axis 39. A second pair of groove bearings 47, 49 is disposed on the rotary pipe 45 and ensures that a translatory pipe 51 secured to the displacer 13 is journalled radially with respect to the rotary pipe 45. The groove bearings of a pair are located, viewed axially, at a sufficiently large relative distance to prevent the relevant parts from being tilted. Depending upon whether the groove bearings should operate solely as bearings or these groove bearings should also exert a pumping effect on the working medium, a given configuration of the groove pattern is chosen. A usual pattern in groove bearings is the so-called herring-bone pattern. It is also possible to use half of a herring-bone pattern. In the piston engine shown in FIG. 1, all bearings 41,43,47 and 49 have a herringbone pattern so that the bearings do not or substantially not exert a pumping effect on the working medium and solely serve as radial bearing. Embodiments will be described hereinafter, in which groove bearings with a netto pumping effect are used.

The rotary pipe 45 is driven by means of an electric rotary motor 53 of a type known per se. An annular rotor magnet 55 of the rotary motor 53 is secured on the rotary pipe 45, while a coil assembly 57 surrounding the rotor magnet 55 is mounted on radially directed coil holders 59, which are integral with a fixedly arranged annular soft iron yoke 61. The rotor magnet 55 has a number of adjacent sections, which are radially magnetized alternately in opposite directions. The rotary motor 53 is therefore a rotary brushless direct current motor. Besides the function of driving the rotary element of the groove bearings 41,43,47,49, the rotary motor 53 may have a further function in connection with a regulation of a central position for the displacer 13. This will be explained more fully hereinafter after FIGS. 2, 3 and 4 have been described.

Figure 2:
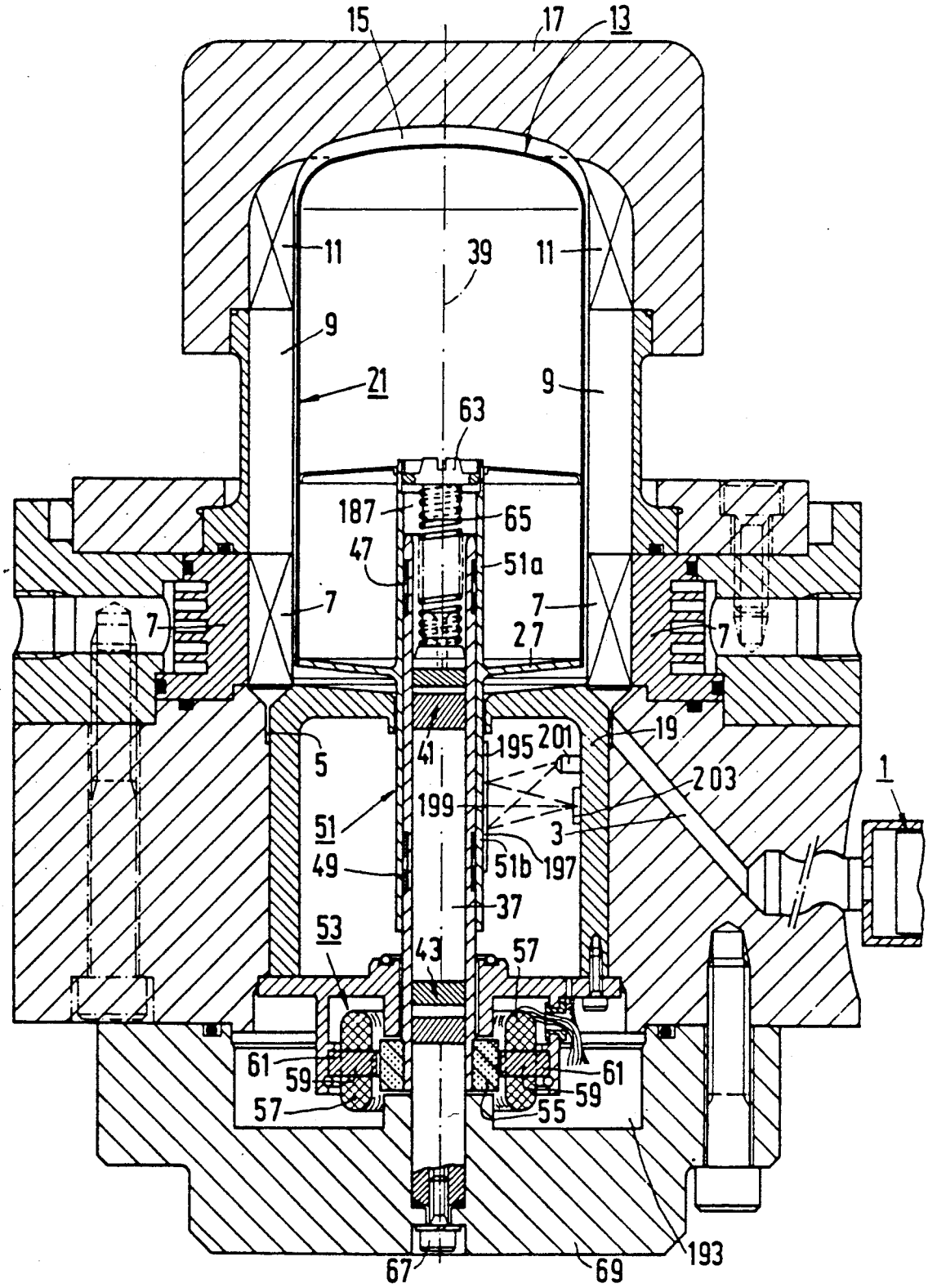
FIG. 2 is a sectional view of a second embodiment of the piston engine.

The second embodiment of the piston engine shown in FIG. 2 is provided as far as possible with reference numerals corresponding to FIG. 1. The main difference from the first embodiment consists in the translatory pipe 51, which is no longer arranged entirely outside the displacer 13, but of which an upper part 51*a* is disposed in the displacer 13 and a lower part 51*b* is disposed outside the displacer. Thus, viewed in the direction of the axis 39, a comparatively short and hence compact construction is obtained. Between the upper side of the guide 37 and a screw cap 63 closing the translatory pipe 51, 51*a* is disposed a helical spring 65, which yields a return force for the displacer 13 and hence guarantees a substantially constant motion frequency of the displacer lying close to the resonant frequency of the mechanical system. The circular-cylindrical guide 37 is secured by means of a bolt 67 to a bottom portion 69 of the housing of the piston engine. As a result, any translation or rotation of the guide 37 is excluded.

Figure 3:
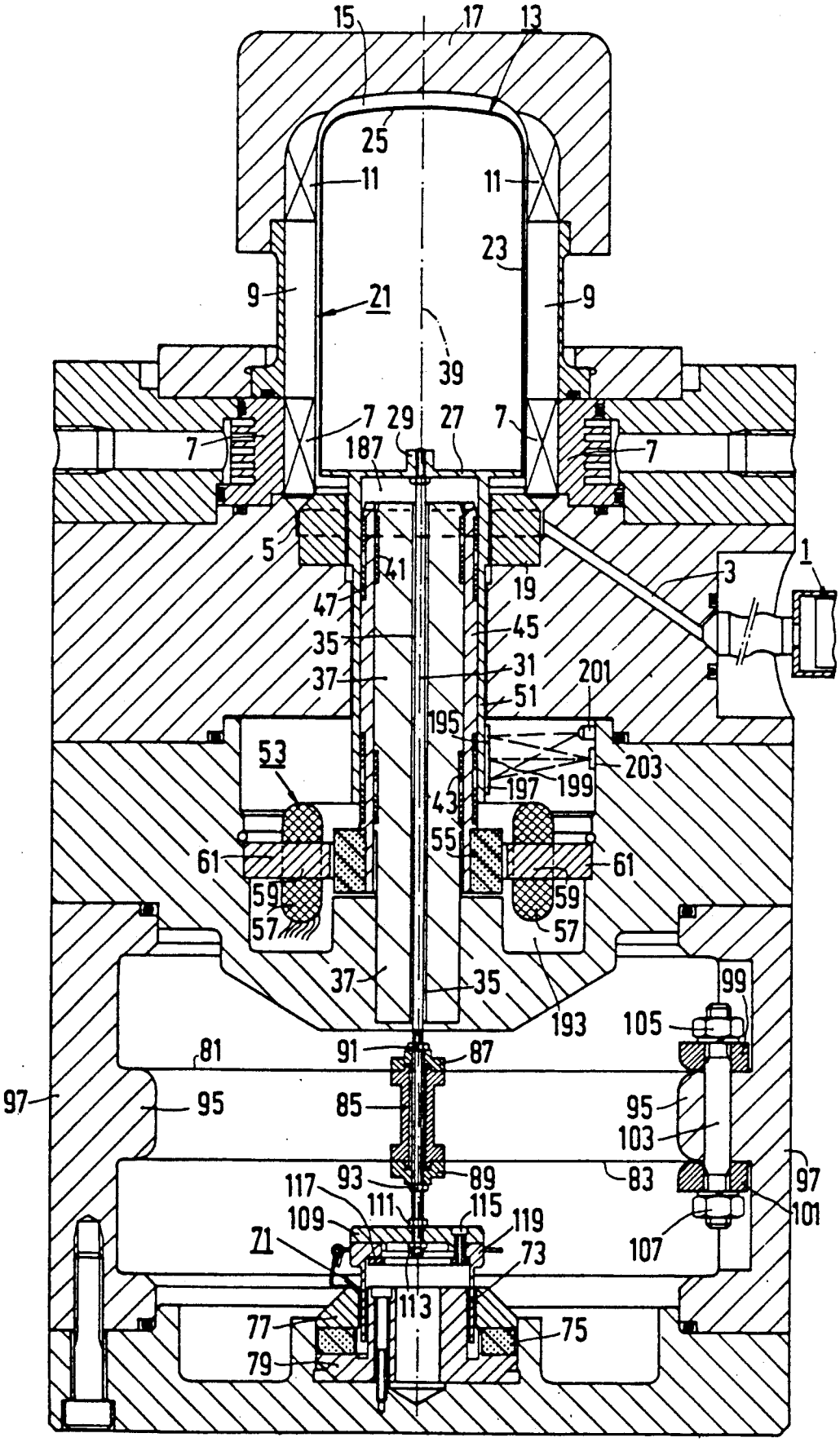
FIG. 3 is a sectional view of a third embodiment of the piston engine.

In the third embodiment shown in FIG. 3, as far as possible the reference numerals corresponding to the preceding Figures are used. With respect to the first embodiment shown in FIG. 1, the third embodiment of the piston engine is extended with a translatory motor 71. The translatory motor 71 may be used in combination with the compressor 1. If a compressor 1 is present and the complete engine is a cooler, the translatory motor 71 can be used to control the phase difference between the compressor and the displacer or to control the amplitude of the displacer movement. Both controls serve to vary the production of cold. If the compressor 1 is omitted and the duct 3 is closed, the translatory motor can be used as main drive for the displacer 13. The cylinder 21 must then be provided with delivery and suction valves, while the cooler 7, the regenerator 9 and the freezer 11 are also omitted. The piston engine according to the invention in this case acts as a compressor in itself with the translatory motor 71 as a drive and the rotary motor 53 as means for centering the displacer/piston 13. The translatory motor 71 is also a brushless direct current motor. The motor 71 has a coil 73, which can be displaced parallel to the axis 39 and extends into the field of an axially magnetized permanent ring magnet 75. Further, the motor 71 is provided with soft-iron yokes 77 and 79. The translatory motor 71 in itself is also of a usual kind. If there is started from the construction shown in FIG. 3, in which event the compressor ensures the required gas pressure fluctuation of the piston engine/cryo-cooler and therefore the main drive of the displacer 13, the translatory motor 71 is used to control the phase difference between compressor movement and displacer movement and/or the amplitude of the displacer 13. The rod 31 is secured near its lower end to two diaphragm springs 81 and 83 so that a displacement of the displacer 13 in the direction of the axis 39 is possible, but any movement in a plane at right angles to the radial rigidity of the diaphragm springs 81 and 83. The diaphragm springs 81 and 83 are provided with central openings, through which the rod 31 is passed. The area of the diaphragm springs 81 and 83 around the said openings is clamped between a spacer 85 and two rings 87 and 89, which are pressed with nuts 91 and 93 screwed onto the rod 31 against the diaphragm springs and the spacer. It is indicated on the righthand side of FIG. 3 that the diaphragm springs 81 and 83 are clamped at their outer edge between an annular flange 95 of a part 97 of the housing of the piston engine and two rings 99 and 101, which are urged by means of a shaft 103 onto which two nuts 185 and 107 are screwed.

It should be noted that in the first embodiment of the piston engine shown in FIG. 1, the rod 31 is secured to diaphragm springs in the same manner as in the third embodiment shown in FIG. 3 and is therefore described only in this connection with reference to FIG. 3. The diaphragm springs 81 and 83 may be dispensed with if the displacer 13 is used as a compressor/piston in the compressor embodiment of the piston engine already described. In this case, however, the rod 31 is maintained by the coupling with the translatory motor 71. In the third embodiment, a circular disk 109 is secured on the rod 31 by means of two nuts 111 and 113. The disk 109 is clamped between these nuts 111 and 113 screwed onto the rod 31. By means of a number of bolts 115 and a ring 117, a coil holder 119 for the coil 73 of the translatory motor 71 is secured to the disk 109.

Figure 4:
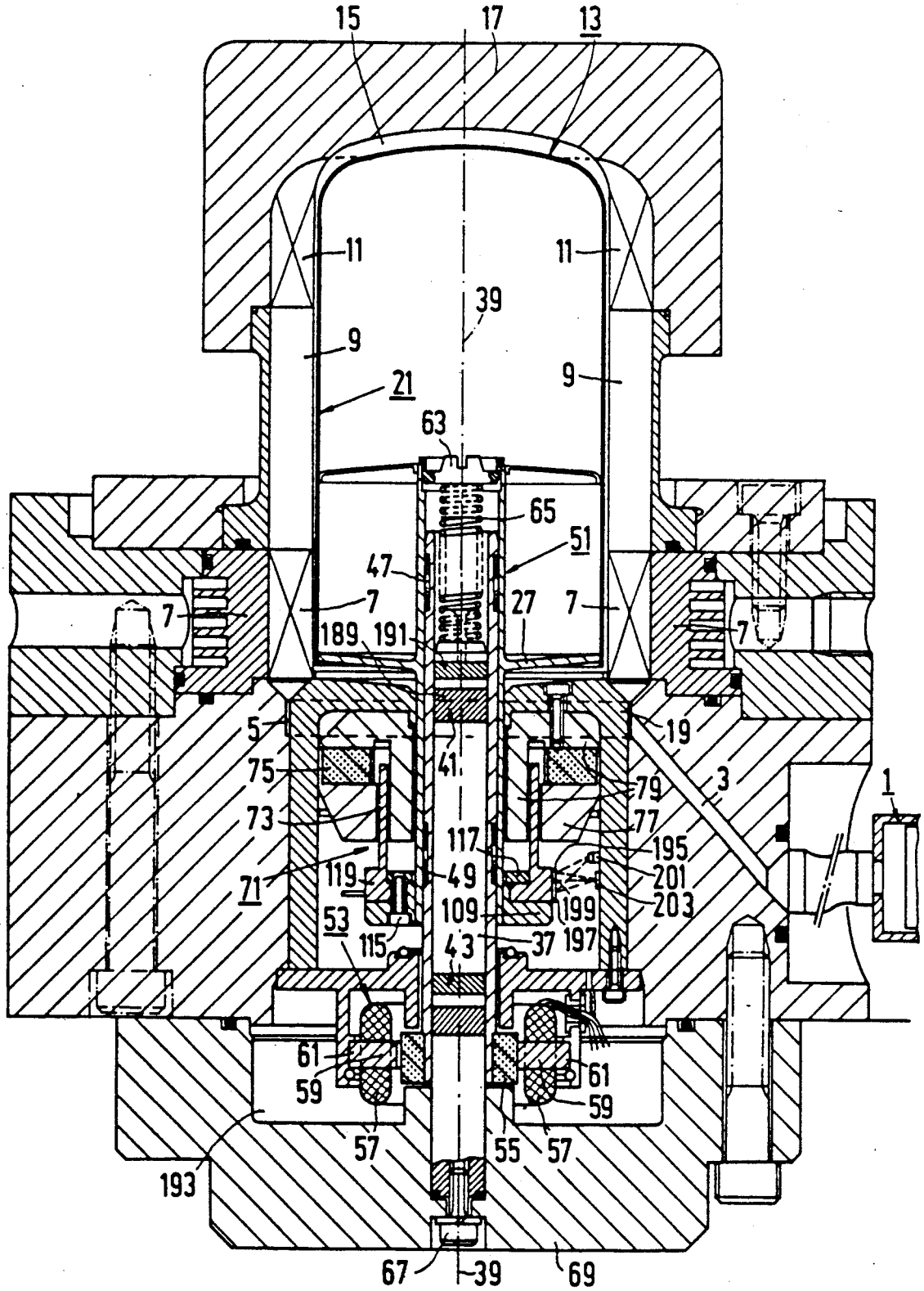
FIG. 4 is a sectional view of a fourth embodiment of the piston engine.

In the fourth embodiment of the piston engine shown in FIG. 4, reference numerals are used, which correspond as far as possible to the reference numerals of FIGS. 1, 2 and 3. With respect to the second embodiment, the fourth embodiment is extended with the translatory motor 71. In an analogous manner, as described, the third embodiment is extended with respect to the first embodiment with the translatory motor 71. With a cryo-cooler, the translatory motor 71 provides the additional possibility of adapting the production of cold by phase or amplitude control. In the very compact construction shown in FIG. 4, the translatory motor 71 is arranged between the displacer 13 and the rotary motor 53 within the sleeve 19.

Figure 5:
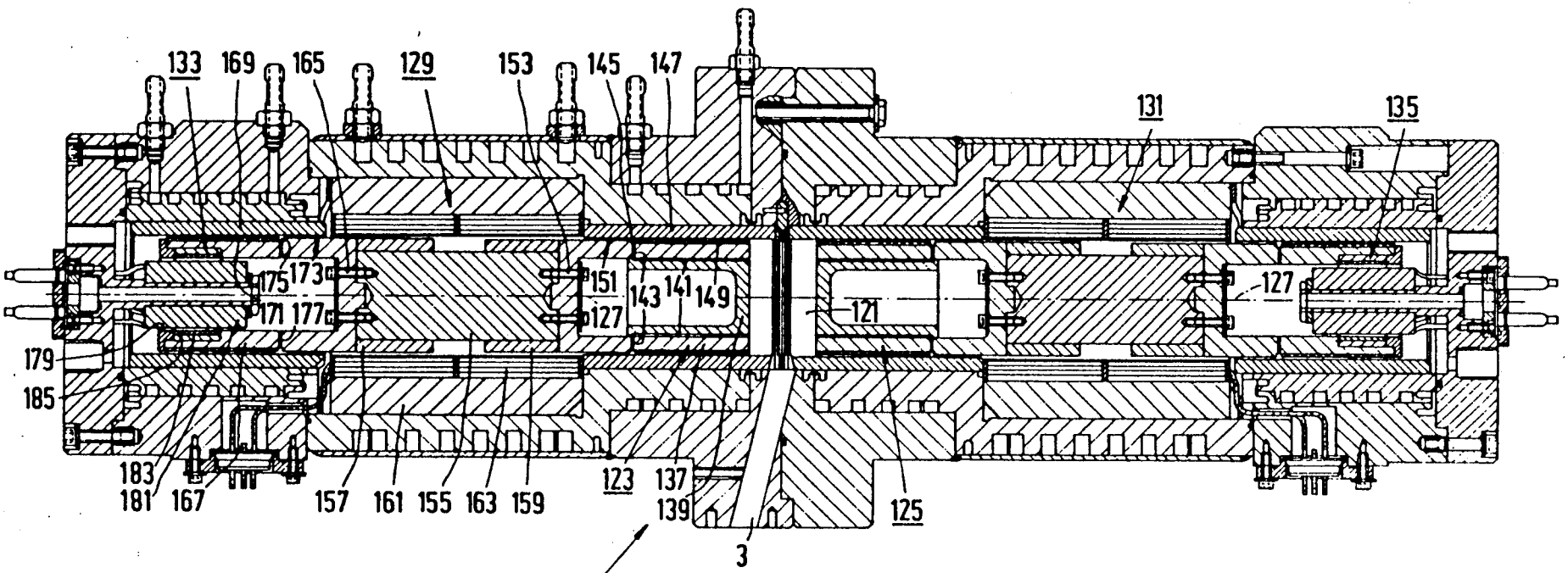
FIG. 5 is a sectional view of a compressor forming a cryo-cooler in combination with a piston engine as shown in one of FIGS. 1 to 4.

The compressor 1 illustrated in FIG. 5 is connected to the duct 3, which is indicated in FIGS. 1 to 4. The duct 3 is in open communication with a working space or compression space 121, which is present between two circular-cylindrical pistons 123 and 125. The pistons 123 and 125 not only can translate along an axis 127 coinciding with their center lines, but are at the same time subjected on behalf of their journalling to a rotation about the axis 127. The translatory movements of the pistons 123 and 125 are relatively shifted in phase by 180° and are obtained by translatory motors 129 and 131, respectively coupled to the pistons 123 and 125. The rotation of the pistons 123 and 125 is obtained by rotary motors 133 and 135. The motors 129, 131, 133 and 135 are all of the brushless direct current motor type. For the sake of brevity, the construction of the translatory motors 129, 131 and of the rotary motors 133, 135 will be described with reference to the translatory motor 129 and the rotary motor 133 intended to be used for the drive of the piston 123. The translatory motor 131 is identical to the translatory motor 129 and also the rotary motor 135 is identical to the rotary motor 133. The piston 123 has an inner sleeve 139, which is mounted in an outer sleeve 137 and is provided at its periphery with a number of ducts 141 parallel to the axis 127. By means of radially extending communication ducts 143, the ducts 141 are connected to an annular duct 145, which is in communication with the gap between the outer sleeve 137 and a first bearing bush 147. The outer surface of the outer sleeve 137 is provided with a groove pattern 149, which upon rotation of the piston 123 acts as a dynamic gas bearing. The groove pattern 149 has the form of a herring-bone. Beside the groove pattern 149, the outer surface of the piston 123 is machined to smoothness in a part 151. Essentially, a piston of the kind of the piston 123 is known from the aforementioned European Patent Application EP-A-1-0223288. By means of bolts 153, a circular-cylindrical core 155 of cobalt iron forming part of the translatory motor 129 is secured to the outer sleeve 137 of the piston 123. Two annular radially magnetized permanent magnets 157 and 159 of a samarium-cobalt alloy are secured on the core 155. Two fixedly arranged coils 161 and 163 surround the core 155 and the permanent magnets 157,159. By means of bolts 165, a circular-cylindrical sleeve 167 guided in a second bearing bush 169 is secured to the core 155. The sleeve 167 is provided at its outer surface with a groove pattern 171, which upon rotation of the sleeve 167 and the piston 123 acts as a dynamic gas bearing. The groove pattern 171 has the form of a herring-bone. Beside the groove pattern 171, the outer surface of the sleeve 167 is machined to smoothness in a part 173. The sleeve 167 is provided with an annular duct 175, which is connected via a number of radial ducts 177 to the inner side of the sleeve. Since the gap between the second bearing bush 169 and the sleeve 167 is thus in open communication with the space within the sleeve 167 and a gap 179 between the sleeve 167 and a fixedly arranged coil 181 passed into the sleeve 167, no inadmissible pressure difference can occur over the part of the sleeve 167 on which the groove pattern 171 is formed. On the inner side of the sleeve 167, a ferromagnetic sleeve 183 and an annular radially magnetized permanent magnet 185 of a samarium-cobalt alloy are secured. The coil 181, the sleeve 183 and the magnet 185 form part of the rotary motor 133. By means of the translatory motor 129 and the rotary motor 133, a simultaneous translation and rotation of the assembly constituted by the piston 123, the core 155 and the sleeve 167 can be obtained. The groove patterns 149 and 171 on the outer sleeve 137 and the sleeve 167, respectively, located at a comparatively great relative distance guarantee a satisfactory dynamic gas bearing of the said assembly so that the assembly remains excellently centered with respect to the axis 127. Since the compressor 1 is constructed symmetrically with regard to the pistons (123,125), the translatory motors (129,131) and the rotary motors (133,135), a fully balanced compressor is obtained with a translatory movement shifted in phase by 180° of the pistons 123 and 125. The compressor 1 can be arranged within given limits at an arbitrary distance from a piston engine of the kind shown in FIGS. 1 to 4.

In particular embodiments of the piston engines shown in FIGS. 1 to 4, use is made of the presence of the dynamic groove bearings to temporarily raise or reduce an average pressure in a chamber 187 limited by the cover plate 27 connected to the piston/displacer and constituting a chamber wall and by the upper ends of the circular-cylindrical guide 37 and of the rotary pipe 45. The side walls of the chamber 187 are constituted by the translatory pipe 51. By means of a pressure variation in the chamber 187, a central position control can be obtained for the displacer 13. The dynamic groove bearing 41 is chosen to exert an upwardly directed pumping effect on the gas in the gap between the guide 37 and the rotary pipe 45. The groove bearing 47 could otherwise also be utilized to exert a pumping effect on the gas in the gap between the rotary pipe 45 and the translatory pipe 51. As is shown in FIGS. 2 to 4, the groove bearing 41 is constructed unsymmetrically with a comparatively large lower groove pattern 189 and a comparatively small upper groove pattern 191, as a result of which the pumping effect is constantly directed upwards. Although this is not visible in FIGS. 1 and 3, the groove bearings 41 of the first and third embodiments also have an unsymmetrical pattern as described. The chamber 187 is through the gap between the rotary pipe 45 and the guide 37 in open communication with a buffer space 193, in which the average pressure prevails. With respect to the average pressure in an engine having a symmetrical groove bearing 41, the average pressure in an engine having an unsymmetrical groove bearing of course lies at a different level. At a constant speed of rotation of the rotary pipe 45, a state of equilibrium is adjusted between the gas transport of the groove bearing and the gas transport through the gap between the rotary pipe and the guide 37 owing to the displacer movement. This state of equilibrium yields a so-called central (mid) position of the displacer 13 corresponding thereto. The axial position of the displacer 13 associated with this central position may vary, for example, due to leakage between the working space and the buffer space 193. Since as a result also the cold production of a cryo-cooler also varies, the axial position of the displacer 13 is maintained by means of the central position control described below.

Figure 6:
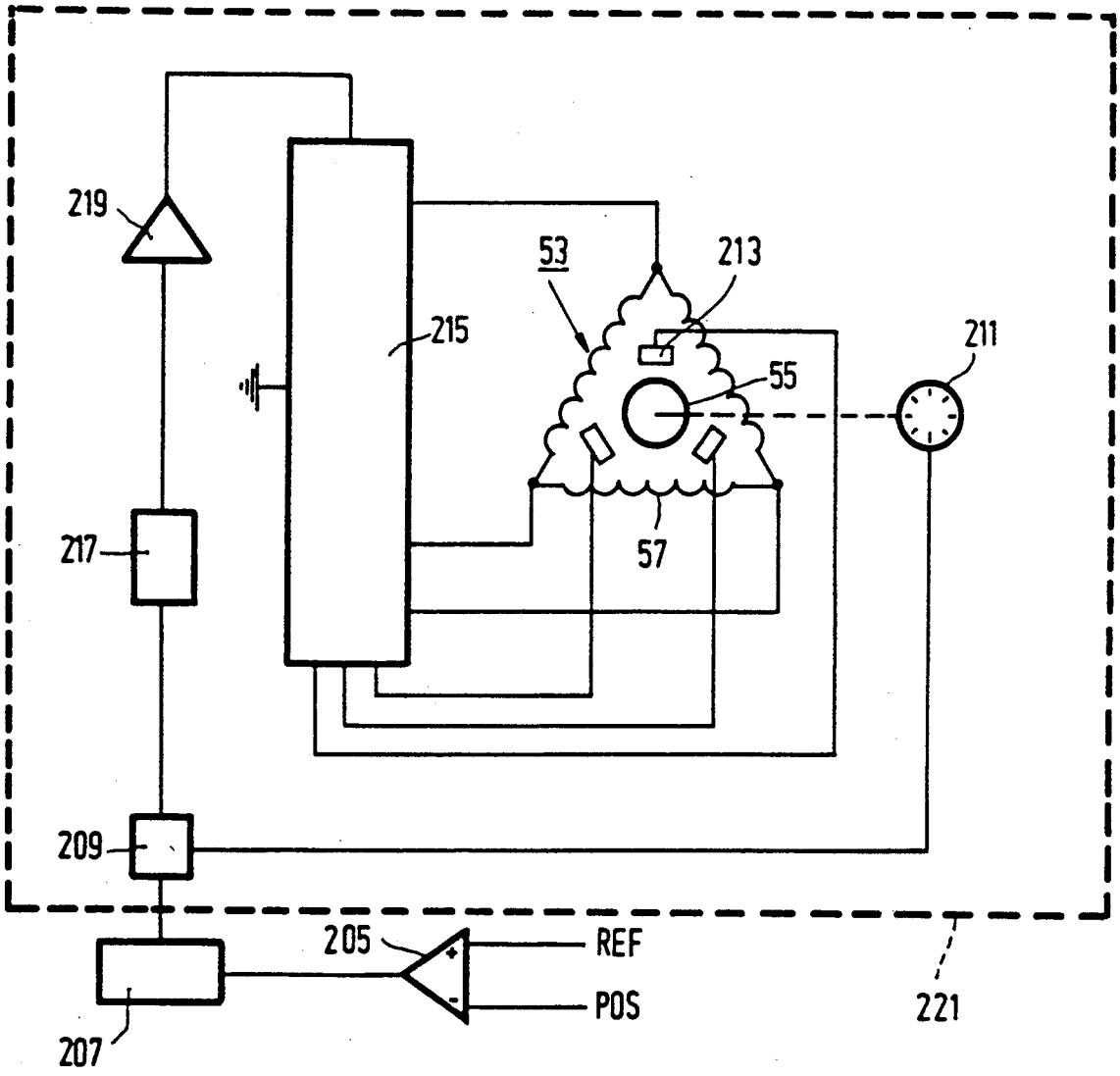
FIG. 6 is a diagrammatic control circuit for the rotary motor used in FIGS. 1–4.

The translatory pipe 51 is provided on its outer side with a light-reflecting region 195 adjoining a light-absorbing region 197. At the area of reference numeral 199, the transition between the regions 195 and 197 is located. A fixedly arranged light source 201 and a fixedly arranged light source 201 and a fixedly arranged photodetector 203 are located opposite to the regions 195 and 197. The size of the regions 195 and 197 is proportioned with respect to the stroke of the displacer 13 so that the light beam of the light source 201 and the measuring beam of the photodetector 203 are constantly located within the regions 195 and 197. With regard to the piston engine shown in FIG. 4, it should be noted that the regions 195 and 197 owing to lack of space are located not on the translatory pipe 51 itself, but on the coil holder 119 secured thereto. The regions (195,197), the light source 201 and the photodetector 203 constitute a position sensor known per se, which is indicated diagrammatically in the drawing. The photodetector 203 supplies an electrical voltage, whose value is directly proportional to the displacement of the said *central position*. It is assumed that this central position corresponds to the location of the reference numeral 199 in FIGS. 1 to 4. The voltage delivered by the photodetector 203 constitutes the position signal supplied to a control circuit for the rotary motor 53. The central (mid) position control for the displacer 13 will be described with reference to FIG. 6 in which the control circuit for the rotary motor 53 is also shown. The position signal (POS) of the photodetector 203 is supplied together with a reference signal (REF) to a differential amplifier 205 (comparator), whose output is connected to the input of a voltage-controlled oscillator 207. By means of the difference voltage from the differential amplifier 205, the frequency of the output signal of the oscillator 207 supplied to a phase detector 209 is adjusted. The phase detector 209 is at the same time connected to the output of a digital tacho 211 coupled to the outgoing shaft of the rotary motor 53. The rotary motor 53 is a brushless direct current motor, of which the fixedly arranged coils 57 are excited by means of field-dependent resistors 213 and a commutation circuit 215. The output signal of the phase detector 209 is passed via a low-pass filter 217 having an integrating effect and an amplifier 219 to the commutation circuit 215. The part of the central (mid) position control described located within a frame 221 belongs to the usual control circuits for electronically commuted direct current motors and is generally designated by the term "phase-locked loop". The advantage of the double function of the groove bearing 41, i.e. the bearing function and the pump function, is that by comparatively inexpensive and simple means a central (mid) position control is obtained for the displacer 13.

It should be noted that the rotary pipe 45 is stationary in the axial direction parallel to the axis 31 because the average pressure prevails at both ends of the pipe. Moreover, the magnetic field of the permanent magnet 55 of the rotary motor 53 holds the rotary pipe 45 in place in the axial direction.

The rotary pipe 45 and the guide 37 may be replaced by a circular-cylindrical guide, which is rotatable about the axis 31 and is provided with two pairs of groove bearings located at a given relative distance. The mass of such a guide is comparatively large, however, if a reasonable diameter of the groove bearings is chosen. In fact, it is comparatively expensive to manufacture groove bearings on a shaft having a comparatively small diameter with associated small gap widths. Finally, it should be noted that the piston/displacer 13 may also be centered by more than two pairs of groove bearings with respect to the cylinder axis 39. This also depends upon the space available.

What is claimed is:

1. In an apparatus comprising a cylinder defining a cylinder axis and a piston having a predetermined radial clearance with said cylinder and being movable in a reciprocating manner in said cylinder for working on a gaseous medium present in said cylinder or for being worked on by said gaseous medium for reciprocating said piston in said cylinder, wherein the improvement comprises:

means for centering said piston in said cylinder for rotation-free reciprocation of said piston in said cylinder, said means comprising an elongate circular cylindrical guide coaxial with said cylinder axis, a rotary member disposed between said guide and said piston, said guide and said rotary member comprising a first pair of axially spaced dynamic grooved bearings for centering said rotary member with respect to said guide during rotation of said rotary member, and said rotary member and said piston comprising a second pair of axially spaced dynamic grooved bearings for centering said piston with respect to said rotary member and said cylinder during rotation of said rotary member.

2. An apparatus as claimed in claim 1, wherein said rotary member is comprised of a rotary pipe concentrically surrounding said circular cylindrical guide and rotatable about said cylinder axis, said apparatus further comprises a rotary drive means for rotating said rotary pipe, and said first pair of axially spaced bearings is comprised of two axially spaced groove patterns on said guide and an inner surface of said rotary pipe which cooperates with said patterns of grooves disposed on said guide.

3. An apparatus as claimed in claim 2, wherein said piston comprises translatory pipe fixed coaxially to said piston, said translatory pipe extending from said piston and surrounding a portion of said rotary pipe, said translatory pipe and said portion of said rotary pipe comprising said second pair of dynamic grooved bearings for centering said translatory pipe with respect to said rotary pipe and said cylinder axis for translation of said translatory pipe during reciprocation of said piston.

4. In a piston engine comprising a cylinder defining a cylinder axis and a piston having a predetermined radial clearance with said cylinder and being movable in a reciprocating manner in said cylinder for working on a gaseous medium present in said cylinder or for being worked on by said gaseous medium for reciprocating said piston in said cylinder, wherein the improvement comprises:

centering means for centering said piston in said cylinder for rotation-free reciprocation of said piston in said cylinder, said centering means comprising a guide coaxial with said cylinder, a translatory member fixed to said piston and extending in the direction of said guide and coaxial with said piston, and a rotary member disposed radially between said guide and said translatory member, said translatory member being translatable with respect to said rotary member during reciprocation of said piston, and rotary drive means for rotating said rotary member, said guide and said rotary member comprising a first pair of axially spaced grooved dynamic bearings for centering said rotary member with respect to said guide for rotation of said rotary member, and said rotary member and said translatory member comprising a second pair of axially spaced grooved dynamic bearings for centering said translatory member with respect to said rotary member for translation of said translatory member during reciprocation of said piston.

5. A piston engine as claimed in claim 4, wherein said rotary member concentrically surrounds said guide and said translatory member surrounds and translates over said rotary member.

6. A piston engine as claimed in claim 5, wherein said translatory member has a portion extending axially into said piston and defining a cavity therein.

7. A piston engine as claimed in claim 6, further comprising said guide having an end face proximate said piston, said end face and said portion of said translatory member extending into said piston forming a chamber having a length varying with the axial translation of said piston during reciprocation, a said dynamic groove bearing comprising an assymetric pattern of grooves for pumping a gas into said chamber during rotation of said rotary member for axially moving said piston, and control means for sensing the axial position of said piston and for controlling the rotational speed of said rotary member for controlling the gas flow into said chamber and the movement of said piston.

8. A piston engine as claimed in claim 7, wherein said rotary drive means comprises an electric rotary motor.

9. A piston engine as claimed in claim 8, wherein said piston engine further comprises a translatory drive means comprising a linear motor for controlling the translation of said piston, and means for connecting said piston to said linear motor.

10. A piston engine as claimed in claim 9, wherein said guide comprises an elongate circular cylinder, and said rotary member and said translatory member each comprise a circular pipe.

11. A piston engine as claimed in claim 6, wherein said guide comprises an elongate circular cylinder, and said rotary member and said translatory member each comprise a circular pipe.

12. A piston engine as claimed in claim 5, wherein said apparatus further comprises a translatory drive means comprising a linear motor for controlling the translation of said piston, and means for connecting said piston to said linear motor.

13. A piston engine as claimed in claim 5, wherein said guide comprises an elongate circular cylinder, and said rotary member and said translatory member each comprise a circular pipe.

14. In a cryo-cooler comprising an expansion chamber defining a chamber axis, a displacer reciprocable in said expansion chamber, and compression means for supplying a gas under pressure to said expansion chamber for reciprocating said displacer, wherein the improvement comprises:

centering means for centering said displacer in said expansion chamber for rotation-free reciprocation of said displacer in said expansion chamber, said centering means comprising a guide coaxial with said expansion chamber, a translatory member fixed to said displacer and extending in the direction of said guide coaxial with said displacer, a rotary member disposed radially between said fixed guide and said translatory member, said translatory member being translatable with respect to said rotary member during reciprocation of said piston, and rotary drive means for rotating said rotary member said fixed guide and said rotary member comprising a first pair of axially spaced grooved dynamic bearings for centering said rotary member with respect to said guide for rotation of said rotary member, and said rotary member and said translatory member comprising a second pair of axially spaced grooved dynamic bearings for centering said translatory member with respect to said rotary member for translation of said translatory member during reciprocation of said displacer.

15. A cryo-cooler as claimed in claim 14, wherein said rotary member concentrically surrounds said guide and said translatory member surrounds and translates over said rotary member.

16. A cryo-cooler as claimed in claim 15, wherein said translatory member has a portion extending axially into said displacer defining a cavity therein.

17. A cryo-cooler as claimed in claim 15, further comprising said guide having an end face proximate said displacer, said end face and said portion of said translatory member extending into said displacer forming a chamber having a length varying with the axial translation of said displacer during reciprocation, a said dynamic groove bearing comprising an assymetric pattern of grooves for pumping a gas into said chamber during rotation of said rotary member for axially moving said displacer, and control means for sensing the axial position of said displacer and for controlling the rotational speed of said rotary member for controlling the gas flow into said chamber and the movement of said displacer.

18. A cryo-cooler as claimed in claim 17, wherein said rotary drive means comprises an electric rotary motor.

19. A cryo-cooler as claimed in claim 18, wherein said cryo-cooler further comprises a translatory drive means comprising a linear motor for controlling the translation of said displacer, and means for connecting said displacer to said linear motor.

20. A cryo-cooler as claimed in claim 19, wherein said guide comprises an elongate circular cylinder, and said rotary member and said translatory member each comprise a circular pipe.

21. A cryo-cooler as claimed in claim 17, wherein said guide comprises an elongate circular cylinder, and said rotary member and said translatory member each comprise a circular pipe.

22. A cryo-cooler as claimed in claim 14, wherein said guide comprises an elongate circular cylinder, and said rotary member and said translatory member each comprise a circular pipe.

23. A cryo-cooler as claimed in claim 14, wherein said cryo-cooler further comprises a translatory drive means comprising a linear motor for controlling the translation of said displacer, and connecting means for connecting said displacer to said linear motor.

24. A cryo-cooler as claimed inc laim 20, wherein said asymmetric pattern of grooves are formed on said rotary pipe, said pattern pumping gas into said chamber via the gap between said rotary pipe and said translatory pipe.

25. A cryo-cooler as claimed in claim 23, wherein said connecting means comprises an elongate rod extending from said displacer through said guide to said translatory motor, and said cryo-cooler further comprises a diaphragm spring connecting to said elongate rod for controlling the movement of said displacer and for centering said elongate rod with said guide.

* * * * *